US006894673B2

(12) United States Patent
Koga et al.

(10) Patent No.: US 6,894,673 B2
(45) Date of Patent: May 17, 2005

(54) LIQUID CRYSTAL DISPLAY CONTROL CIRCUIT

(75) Inventors: Koichi Koga, Tokyo (JP); Noboru Okuzono, Tokyo (JP); Machihiko Yamaguchi, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 488 days.

(21) Appl. No.: 10/192,101

(22) Filed: Jul. 10, 2002

(65) Prior Publication Data

US 2003/0011557 A1 Jan. 16, 2003

(30) Foreign Application Priority Data

Jul. 13, 2001 (JP) ..... 2001-214530

(51) Int. Cl.[7] ..... G09G 3/36
(52) U.S. Cl. ..... 345/99; 345/94; 345/100
(58) Field of Search ..... 345/87–100, 204, 345/208–211

(56) References Cited

U.S. PATENT DOCUMENTS 6,151,016 A * 11/2000 Kanbe et al. ..... 345/204
2002/0024482 A1 * 2/2002 Song et al. ..... 345/87
2003/0038766 A1 * 2/2003 Lee et al. ..... 345/87

FOREIGN PATENT DOCUMENTS

JP 10-301544 11/1998

* cited by examiner

*Primary Examiner*—Regina Liang
(74) *Attorney, Agent, or Firm*—Choate, Hall & Stewart LLP

(57) ABSTRACT

A liquid crystal display control circuit receives a data enable signal DE in synchronization with per-line based display data from a computer, and thereby controls a liquid crystal display. A gate drive signal outputted from a gate driver 23 is generated according to a vertical clock signal VCK in synchronization with a rise of the signal DE. In order to avoid a variation in the period of charging the pixel electrodes which is caused by a delay in the rise timing of the signal DE and a delay in the signal VCK after the last line, a gate enable signal generation circuit 10 is provided in the liquid crystal display control circuit 1, whereby the extended output of the pulse of the gate drive signal caused by the above-mentioned delays is inhibited. This avoids display inhomogeneity caused by a variation in the data enable signal and the like.

18 Claims, 10 Drawing Sheets

FIG. 10A
METHOD OF DETERMINING Tx EXAMPLE: INTRA-FRAME MAXIMUM AND INTER-FRAME MINIMUM VALUE
| FRAME | INTRA-FRAME tmax | tmax | tx |
|---|---|---|---|
| 1 | tmax1 | tmax1 | tmax1 |
| 2 | tmax2 | tmax2 | tmax1 |
| 3 | tmax3 | tmax2 | tmax3 |
| 4 | tmax4 | tmax4 | tmax3 |
tmax3 < tmax1 < tmax2 < tmax4
FIG. 10B
WRITE OF LAST LINE (DUMMY HRST)
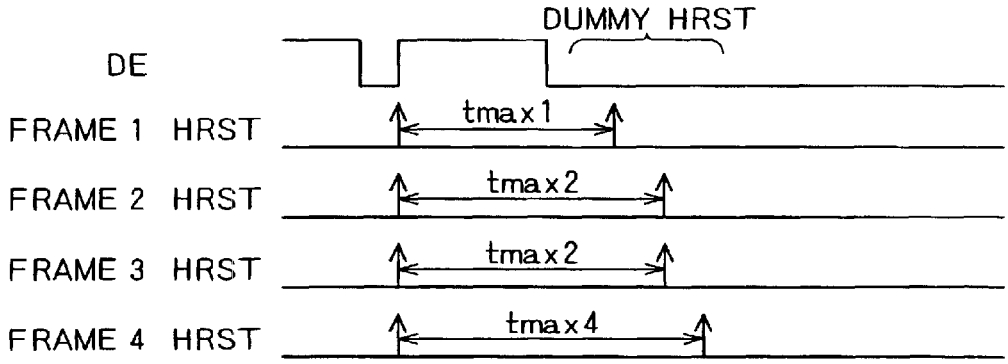
FIG. 10C
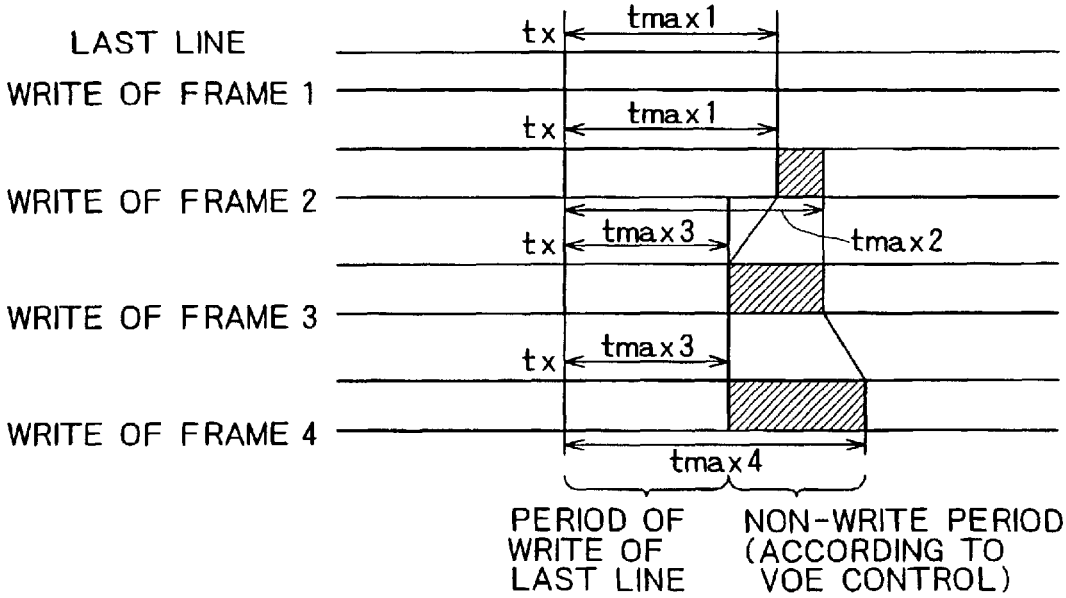

LIQUID CRYSTAL DISPLAY CONTROL CIRCUIT

BACKGROUND OF THE INVENTION

1. Technical Field of the Invention

The present invention relates to a liquid crystal display control circuit for controlling the display of a liquid crystal display.

2. Description of the Related Art

In recent years, liquid crystal displays (LCDs) are most widely used as display apparatuses in computers, office automation equipment, and mobile terminals. A prior art thin-film transistor (TFT) liquid crystal display in a computer is generally described below with reference to the drawings.

FIG. 1 shows the general configuration of a liquid crystal display system, while FIG. 2 shows signal waveforms at various points in the system.

As shown in FIG. 1, the liquid crystal display system comprises: a computer 7 for outputting digital display data (display data, hereafter) together with a clock signal and a control signal; a liquid crystal display 6; and a liquid crystal display control circuit 5 for inputting the signals which have been received from the computer 7 and thereby drive and control the liquid crystal display 6.

The liquid crystal display 6 comprises: a liquid crystal display panel 61 in which pixel electrodes for displaying and TFT transistors for applying a voltage on each pixel electrode are arranged in a matrix form on a substrate; a source driver 62 arranged on the top side of the liquid crystal display panel 61; and a gate driver 63 arranged on the left side. Display data latched by the source driver 62 on a per-horizontal-line basis is D/A-converted into gradation voltages. The gradation voltages are written into the pixel electrodes of the liquid crystal display panel 61 sequentially from top to bottom on a per-horizontal-line basis. Accordingly, the voltage for each pixel is applied between each pixel electrode and a common electrode. As a result, the transmissivity of the liquid crystal between each electrode pair is controlled in response to the applied voltage, whereby displaying is carried out.

The computer 7 comprising a graphic chip controller 71 processes image data and thereby outputs: display data segmented into each line; a single synchronization control signal (data enable signal, hereafter) DE in synchronization with the display data; and a dot clock signal DCK; through a bus to the liquid crystal display.

In response to the three signals (DATA, DE, and DCK), the liquid crystal display control circuit 5 generates various signals for the liquid crystal display 6, and thereby controls the source driver 62 and the gate driver 63. Accordingly, the drivers 62 and 63 drive the liquid crystal display panel 61.

Signal processing in the liquid crystal display control circuit and the drive method of the liquid crystal display are generally described below with reference to FIG. 2.

In FIG. 2, display data is display-use data of image data segmented into each line along the time axis. A dot clock signal DCK is a clock signal having the same data rate (repetition frequency) as that of the display data. A data enable signal DE is a synchronization control signal. In this signal, a data period for each line of the display data is indicated as a valid display data period by a high level, and a data intermission is indicated as an invalid period by a low level. Further, a frame intermission between the last line of a frame and the first line of the next frame is indicated by a low level at a longer time. That is, in the data enable signal DE, horizontal synchronization control is carried out in response to a rise from low to high, while vertical synchronization control is carried out in response to a long low level period. These signals are provided from the computer as described above.

The liquid crystal display control circuit 5 outputs: a reference signal HRST composed of a reference signal generated in response to the detection of a rise timing to the high level of the data enable signal DE in each line or a later-described dummy reference signal generated in the long low level period after the last line of a frame; a horizontal start pulse signal HSP which is generated after several dot clock signals in synchronization with the HRST and thereby controls the start of a horizontal scan; a horizontal clock signal HCK; and a vertical start pulse signal VSP of a vertical scan which is generated in response to the detection of a long low level period of the signal DE.

In each occurrence of a reference signal HRST, the time distance from the preceding reference signal HRST is measured, whereby the maximum time distance (maximum value) is successively renewed and stored. Then, the above-mentioned dummy reference signal HRST is generated when the next DE rise does not occur after the maximum value has elapsed after the tail edge of the last high level period of the DE signal of a frame.

The liquid crystal display control circuit 5 is reset by the reference signal HRST and the dummy reference signal HRST, and then, using a counter for counting the signal DCK, outputs: a vertical clock signal (gate clock signal) VCK generated slightly before a tail edge of the signal DE and thereby used for vertical synchronization; and a data latch pulse signal DLP generated slightly after a tail edge of the signal DE and thereby latching the display data on a per-line basis.

FIG. 3 shows a detailed example of a liquid crystal display control circuit for generating the above-mentioned signals. The circuit comprises: a rise detection circuit 21; a horizontal counter 22; a decoder 25; a TD value (maximum value) determination circuit for detecting the above-mentioned maximum time distance (maximum value); a coincidence detection circuit 27; and a data conversion circuit 30. The horizontal counter 22 is reset by the reference signal HRST outputted from the rise detection circuit 21 via an OR circuit 23, then counts the signal DCK, and thereby outputs the count value continuously. The TD value (maximum value) determination circuit comprises: a register 26 for latching the count value of the horizontal counter 22 at the time of an occurrence of the reference signal; a register 28 (having an initial value of zero) for retaining the maximum time distance data; and a greater value detection circuit 29 for comparing the outputs of the two registers and thereby renewing and retaining the greater value in the register 28; whereby the count value (maximum value) corresponding to the maximum time distance until that point is renewed and stored. When the count value in the horizontal counter 22 during a long low level period of the signal DE exceeds the registered data (TD value) in the register 28, the coincidence detection circuit 27 outputs a dummy reference signal HRST to the OR circuit 23. As a result, the OR circuit 23 outputs a signal HRST composed of the dummy reference signal. The count value outputted from the horizontal counter 22 during the above-mentioned operation is compared with a predetermined count value by the decoder 25, whereby the above-mentioned signals HSP, HCK, DLP, and VCK are outputted in synchronization with a rise timing of the signal DE. In synchronization with the dot clock signal DCK, the data conversion section 30 receives the above-mentioned display data which is 18-bit (6 bits×3) serial data composed of three pieces (for R, G, and B, respectively) of 6-bit data for each pixel. Then, the data conversion section 30 converts the display data into parallel data, and then outputs the data in synchronization with the horizontal clock signal HCK (see Japanese Unexamined Patent Publication No. Hei-10-301544).

The signal DCK is an external clock signal in synchronization with the display data inputted to the liquid crystal display control circuit 5, while the signal HCK is an internal clock signal in synchronization with the display data outputted from the liquid crystal display control circuit 5. The signal HCK is generated according to the signal DCK, in a form corresponding to an output display data form determined by the driver group configuration of the source driver and the input form for the source driver. The vertical clock signal VCK defines the pulse width of the gate drive signal outputted from the gate driver.

The source driver 62 and the gate driver 63 for the liquid crystal display panel 61 are controlled with the above-mentioned signals. The operations of the source driver 62 and the gate driver 63 are described below.

Using the horizontal start pulse signal HSP as a start (horizontal synchronization) signal, the source driver 62 sequentially reads DATA during a high level period of the signal DE according to the horizontal clock signal HCK. When data for one line has been read, the data is latched in an internal latching circuit according to the signal DLP, and then D/A-converted into gradation voltages in the number of pixels per line. The voltage signals are provided to the source wires of the corresponding TFT transistors. Such operation is repeated.

Using the signal VSP as a start (vertical synchronization) signal, the gate driver 63 outputs gate drive signals having the same pulse spacing as that of the vertical clock signal VCK, sequentially to the gate wires. Accordingly, TFT transistors for the line are driven sequentially, whereby the transistors for the line turn ON. Such an operation is repeated.

FIG. 4 shows signals for a driving operation of a specific gate wire and a specific source wire. The figure shows a data latch pulse signal DLP, a vertical clock signal VCK, a gate drive signal for the gate wire (a signal for controlling the gate-ON period), and the charging voltage (simply a data output, hereafter) for the source wire according to the data output (gradation voltage). The source driver 62 outputs the gradation voltage to the source wire during a DLP pulse spacing, while the gate driver 63 drives the gate wire during a VCK pulse spacing. The gradation voltage provided to the source wire serves as a charging voltage waveform for charging the source wire and the pixel electrode. The final charging voltage for the pixel electrode is the charging voltage at the tail edge of the gate-ON period. This voltage is retained to the next frame, and thereby determines the transmissivity of each pixel of the liquid crystal display panel.

As such, the period in which the source driver 62 reads one-line of data and thereby outputs them as the gradation voltages is the period from a DLP pulse after the reading of the one-line of data to the next DLP pulse. That is, the previous one-line data is written in a period overlapping the next line period. The signal DLP for defining the last timing of the output of the gradation voltage and the signal VCK for defining the tail edge of the gate-ON period are outputted by using rising of the signal DE as the reference and then counting the signal DCK. Thus, the dummy reference signal HRST is indispensable at the rise for the last line of a frame which has no next line.

Nevertheless, in a display data providing apparatus (such as a computer) which outputs display data for liquid crystal display by using a data enable signal DE, the process of converting image data into a per-line based display data corresponding to the resolution of the liquid crystal display panel can cause a delay in the line data spacing of the outputted display data, that is, a delay in a rise timing of the data enable signal DE (equivalently, the tail edge of a low level period). Further, the timing of the pseudo signal HRST (dummy signal HRST) generated in a long low level period for vertical synchronization in the data enable signal can suffer a delay relative to the preceding rise (HRST) of the signal DE in comparison with the other preceding HRST pulse spacing (see Japanese Unexamined Patent Publication No. Hei-10-301544).

As described above, the timing of generation of the signal HRST varies depending on the delay variations in the timing of a rise of the data enable signal DE and the timing of generation of the dummy reference signal HRST. This causes a delay in the timing of generation of the signals DLP and VCK, and thereby affects the displaying of the liquid crystal display panel.

FIG. 5 illustrates the mechanism of affecting the displaying of the liquid crystal display panel. As shown by the broken lines in FIG. 5, when a low level period for horizontal synchronization of the signal DE is extended, or when a delay occurs in the dummy reference signal HRST generated at a long low level period for vertical synchronization, the signals DLP and VCK also delay. As shown by the broken lines in FIG. 5, the delay in the signals DLP and VCK extends the duration of charging with the gradation voltage, and hence the ON-period of the TFT transistors. This causes a variation in the final charging voltage for each pixel electrode. This affects the transmissivity of the liquid crystal display panel, and thereby causes degradation in the display quality such as display inhomogeneity.

SUMMARY OF THE INVENTION

An object of the invention is to provide a liquid crystal display control circuit and a liquid crystal display capable of suppressing the occurrence of display inhomogeneity caused by the variation in the data enable signal and the like.

An aspect of the invention is a liquid crystal display control circuit receiving a dot clock signal (DCK), per-line based display data (DATA), and a data enable signal (DE) in synchronization with the display data, and thereby defining the pulse width of a gate drive signal outputted from a gate driver (for example, numeral 23 in FIG. 6), according to a vertical clock signal (VCK) in synchronization with a reference signal (HRST) generated at rise timings of the data enable signal and a timing delayed by a predetermined time after the last rise within a frame of the data enable signal.

This liquid crystal display control circuit according to the invention comprises a gate enable signal generation circuit (for example, numeral 10 in FIG. 6) for outputting a gate driver output enable signal (for example, VOE in FIG. 7) having a predetermined time width (for example, tx in FIG. 7) starting from the vertical clock signal (VCK), whereby the gate driver (for example, numeral 23 in FIG. 6) is controlled and enabled to output the gate drive signal only during the predetermined time width (for example, tx in FIG. 7) of the gate driver output enable signal (for example, VOE in FIG. 7), and whereby a variation (for example, ts in FIG. 7) in the rise timings of the data enable signal affecting displays is suppressed. Further, this liquid crystal display control circuit outputs: display data (for example, DATA in FIG. 7), a horizontal start pulse signal (for example, HSP in FIG. 7), a horizontal clock signal (HCK), and a data latch pulse signal (for example, DLP in FIG. 7) for controlling the latching of the per-line-based display data, to a source driver; and a vertical start pulse signal(for example, VSP in FIG. 7) to a gate driver; in synchronization with the reference signal.

In the above-mentioned liquid crystal display control circuits, another aspect of the invention is a liquid crystal display control circuit wherein the predetermined time width (for example, tx in FIG. 7) of the gate driver output enable signal is set to be the intra-frame maximum value and the inter-frame minimum value of the spacing of the reference signal generated at rise timings of the data enable signal.

More specifically, the liquid crystal display control circuit comprises: a horizontal counter (for example, numeral 13 in FIG. 9) which is reset by the reference signal generated at rise timings of the data enable signal, and then counts the dot clock signal; an intra-frame maximum value retaining register (for example, numeral 152 in FIG. 9) for sequentially comparing (for example, numeral 153 in FIG. 9) the maximum count value of the horizontal counter before each reset, and thereby retaining the greater count value; an inter-frame minimum value retaining register (for example, numeral 173 in FIG. 9) for comparing (for example, numeral 174 in FIG. 9) sequentially frame by frame the count value retained in the intra-frame maximum value retaining register, and thereby retaining the smaller count value; a decoder (for example, numeral 14 in FIG. 9) for comparing the count value in the horizontal counter with the count value in the intra-frame maximum value retaining register, thereby generating the reference signal (for example, a dummy reference signal HRST in FIG. 9) at a timing delayed by a predetermined time after the last rise within a frame of the data enable signal, and thereby resetting the horizontal counter; and the gate enable signal generation circuit (for example, numeral 18 in FIG. 9) for comparing (for example, numeral 182 in FIG. 9) the count value in a counter (for example, numeral 181 in FIG. 9) which is reset by the vertical clock signal and then counts the dot clock signal with the count value in the inter-frame minimum value retaining register (for example, numeral 173 in FIG. 9), and thereby outputting a gate driver output enable signal (for example, VOE in FIG. 9) having a predetermined time width.

In the above-mentioned liquid crystal display control circuits, another aspect of the invention is a liquid crystal display control circuit wherein the predetermined time width of the gate driver output enable signal is set to be a fixed value not exceeding the intra-frame maximum value of the spacing of the reference signal generated at rise timings of the data enable signal.

More specifically, the liquid crystal display control circuit comprises: a horizontal counter which is reset by the reference signal generated at rise timings of the data enable signal, and then counts the dot clock signal; an intra-frame maximum value retaining register (for example, numeral 152 in FIG. 9) for sequentially comparing the maximum count value of the horizontal counter before each reset, and thereby retaining the greater count value; a decoder (for example, numeral 14 in FIG. 9) for comparing the count value in the horizontal counter with the count value in the intra-frame maximum value retaining register, thereby generating the reference signal at a timing delayed by a predetermined time after the last rise within a frame of the data enable signal, and thereby resetting the horizontal counter; and the gate enable signal generation circuit (for example, numeral 18 in FIG. 9) for comparing the count value in a counter (for example, numeral 18 in FIG. 9) which is reset by the vertical clock signal and then counts the dot clock signal with a fixed number (for example, a fixed number is set in place of numeral 17 in FIG. 9) corresponding to the fixed value, and thereby outputting a gate driver output enable signal having a predetermined time width.

In the above-mentioned liquid crystal display control circuits, another aspect of the invention is a liquid crystal display control circuit wherein the predetermined time width of the gate driver output enable signal is set to be the intra-frame minimum value of the spacing of the reference signal generated at rise timings of the data enable signal.

More specifically, the liquid crystal display control circuit comprises: a horizontal counter which is reset by the reference signal and then counts the dot clock signal; an intra-frame maximum value retaining register (for example, numeral 152 in FIG. 9) for sequentially comparing the maximum count value of the horizontal counter before each reset, and thereby retaining the greater count value; an intra-frame minimum value retaining register for sequentially comparing the maximum count value of the horizontal counter before each reset, and thereby retaining the smaller count value; a decoder (for example, numeral 14 in FIG. 9) for comparing the count value in the horizontal counter with the count value in the intra-frame maximum value retaining register, thereby generating the reference signal at a timing delayed by a predetermined time after the last rise within a frame of the data enable signal, and thereby resetting the horizontal counter; and the gate enable signal generation circuit for comparing the count value in a counter which is reset by the vertical clock signal and then counts the dot clock signal with the count value in the intra-frame minimum value retaining register, and thereby outputting a gate driver output enable signal having a predetermined time width.

In the above-mentioned liquid crystal display control circuits, another aspect of the invention is a liquid crystal display control circuit wherein the predetermined time width of the gate driver output enable signal is set to be the intra-frame mean count value or the most frequent count value of the spacing of the reference signal generated at rise timings of the data enable signal.

More specifically, the liquid crystal display control circuit comprises: a horizontal counter which is reset by the reference signal generated at rise timings of the data enable signal, and then counts the dot clock signal; an intra-frame maximum value retaining register for sequentially comparing the maximum count value of the horizontal counter before each reset, and thereby retaining the greater count value; calculating means for outputting the mean count value or the most frequent count value of the maximum count value in the horizontal counter; a decoder for comparing the count value in the horizontal counter with the count value in the intra-frame maximum value retaining register, thereby generating the reference signal at a timing delayed by a predetermined time after the last rise within a frame of the data enable signal, and thereby resetting the horizontal counter; and the gate enable signal generation circuit for comparing the count value in a counter which is reset by the vertical clock signal and then counts the dot clock signal with the count value outputted from the calculating means, and thereby outputting a gate driver output enable signal having a predetermined time width.

In order to avoid a variation in the duration of charging the pixel electrodes caused by a variation in the tail edge of the gate drive signal caused by a variation in rise timing of the data enable signal, and thereby to avoid influence to the display of the liquid crystal display panel, generated is a control signal (referred to as a gate driver output enable signal) for permitting the output from the gate driver to the gate wires only during a predetermined time width. Accordingly, avoided is the delayed output in the tail of the gate drive signal outputted from the gate driver. The width of the gate driver output enable signal is set to be the intra-frame maximum value and the inter-frame minimum value. Alternatively, the width may be a predetermined fixed value, the minimum value within a horizontal period, or the mean value or the most frequent value within a horizontal period.

BRIEF DESCRIPTION OF THE DRAWINGS

FIG. 10 illustrates a method for determining a value tx in the operation according to an embodiment.

DETAILED DESCRIPTION OF THE PREFERRED EMBODIMENTS

A liquid crystal display control circuit according to the embodiments of the invention is described below with reference to the drawings.

Figure 1:
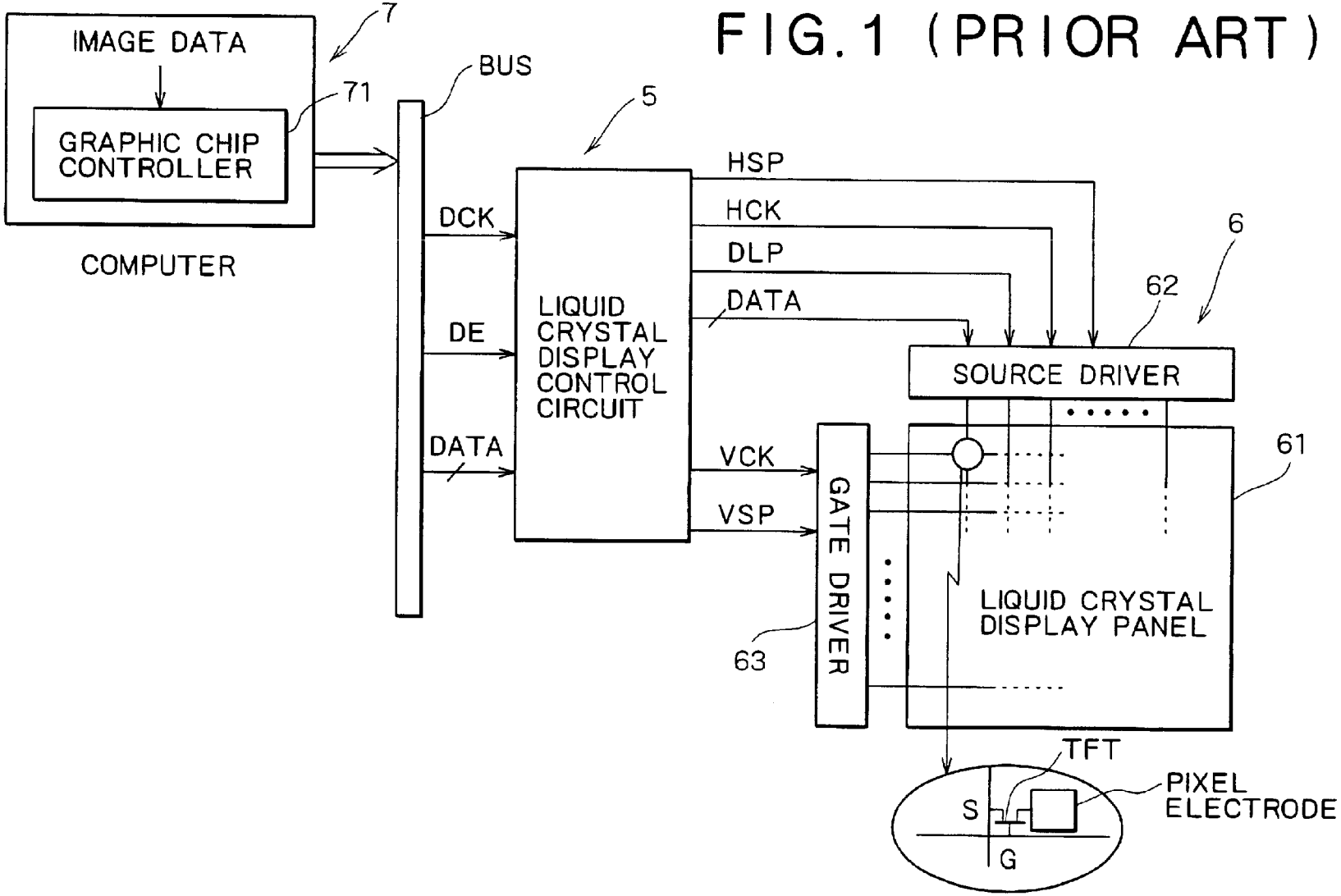
FIG. 1 (PRIOR ART)
FIG. 1 shows the general configuration of a prior art liquid crystal display system.
Figure 2:
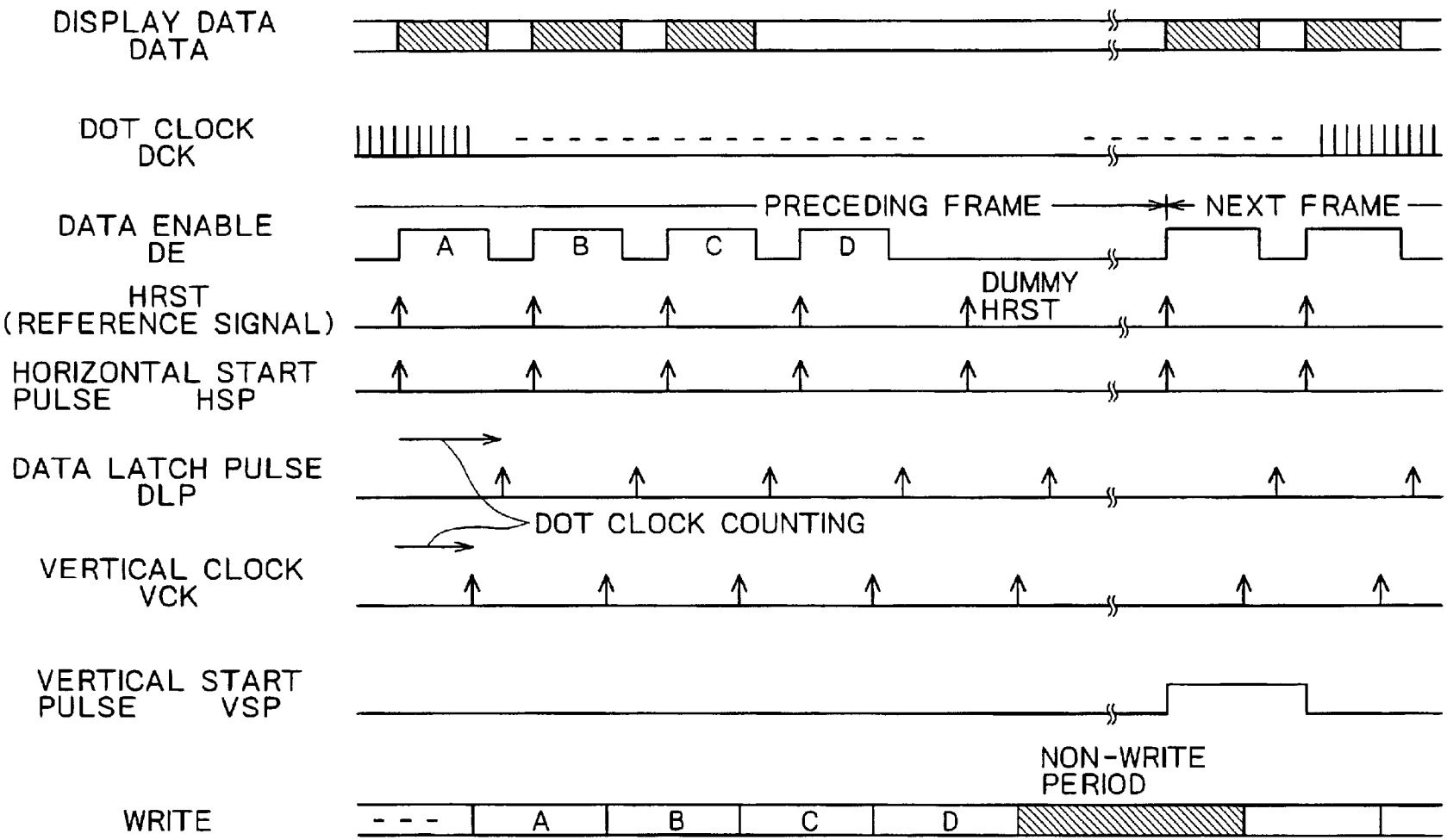
FIG. 2 (PRIOR ART)
FIG. 2 shows signal waveforms at various points in a prior art liquid crystal display system
Figure 3:
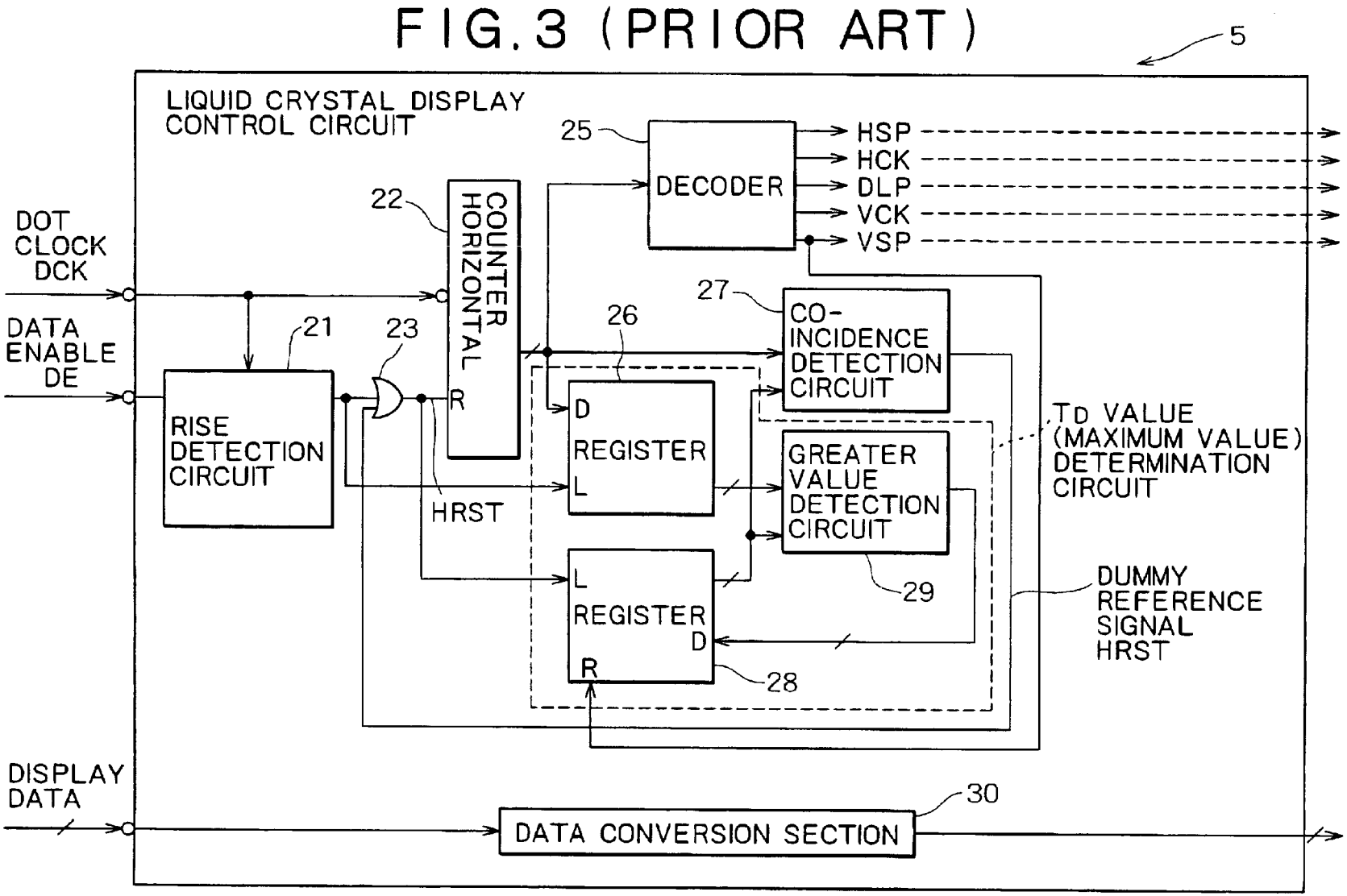
FIG. 3 (PRIOR ART)
FIG. 3 shows a prior art liquid crystal display control circuit for generating various signals for controlling a liquid crystal display.
Figure 4:
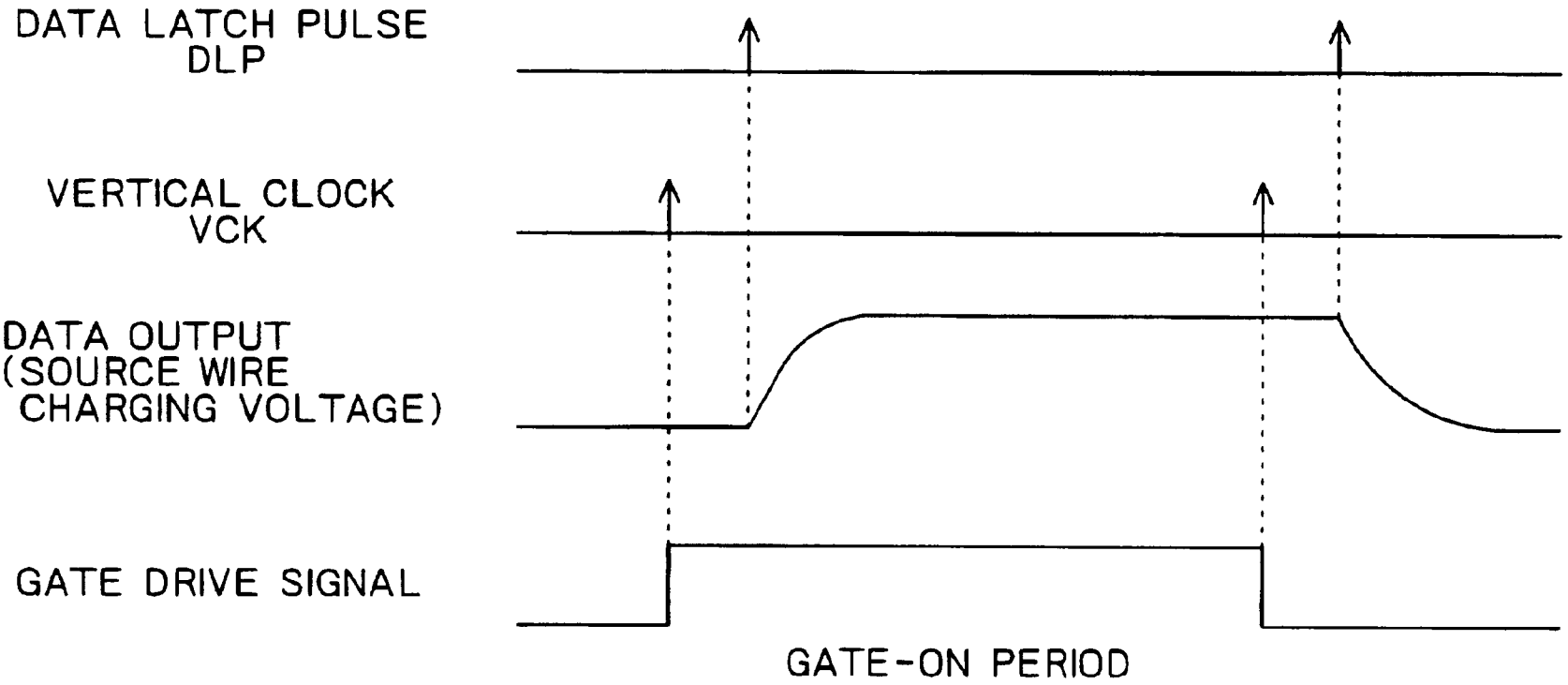
FIG. 4 (PRIOR ART)
FIG. 4 illustrates a driving operation of a specific gate wire and a specific source wire, and the duration of write (charging) of a gradation voltage.
Figure 5:
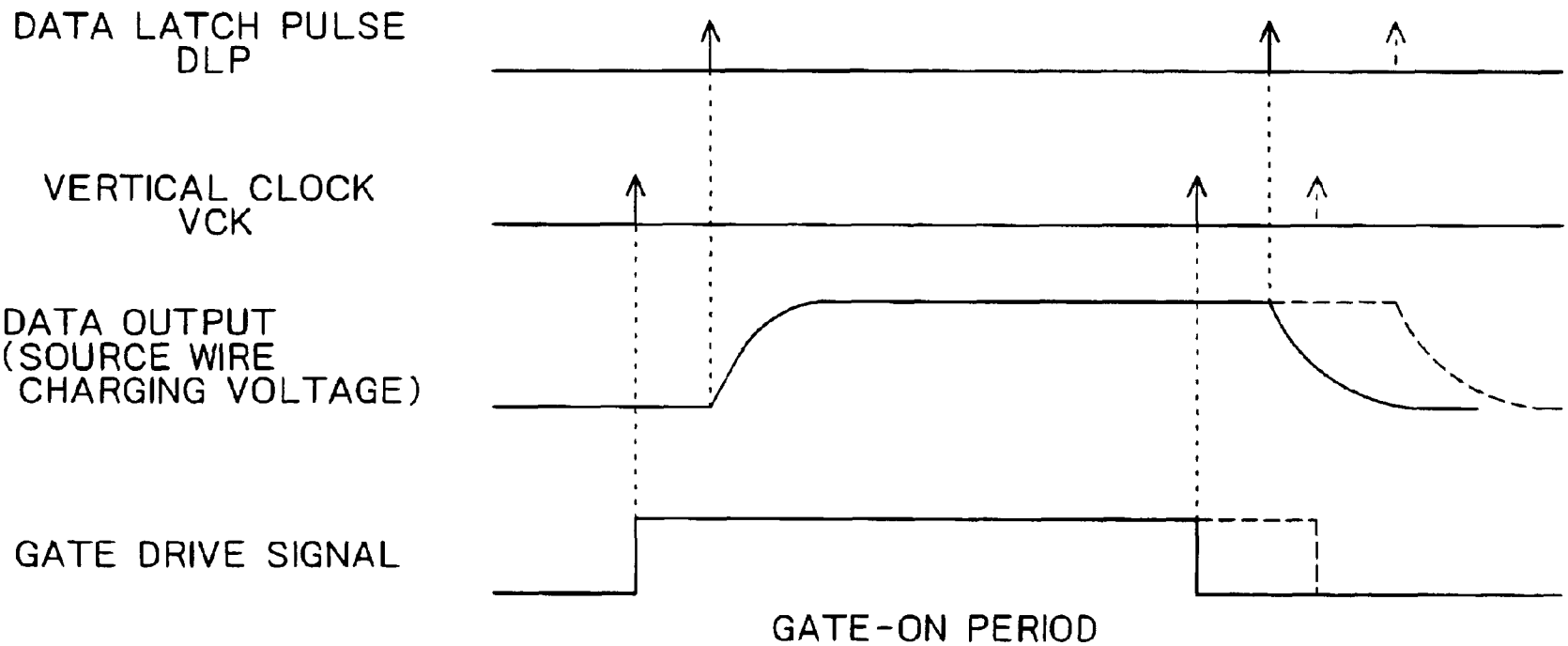
FIG. 5 (PRIOR ART)
FIG. 5 illustrates the mechanism causing display inhomogeneity.
Figure 6:
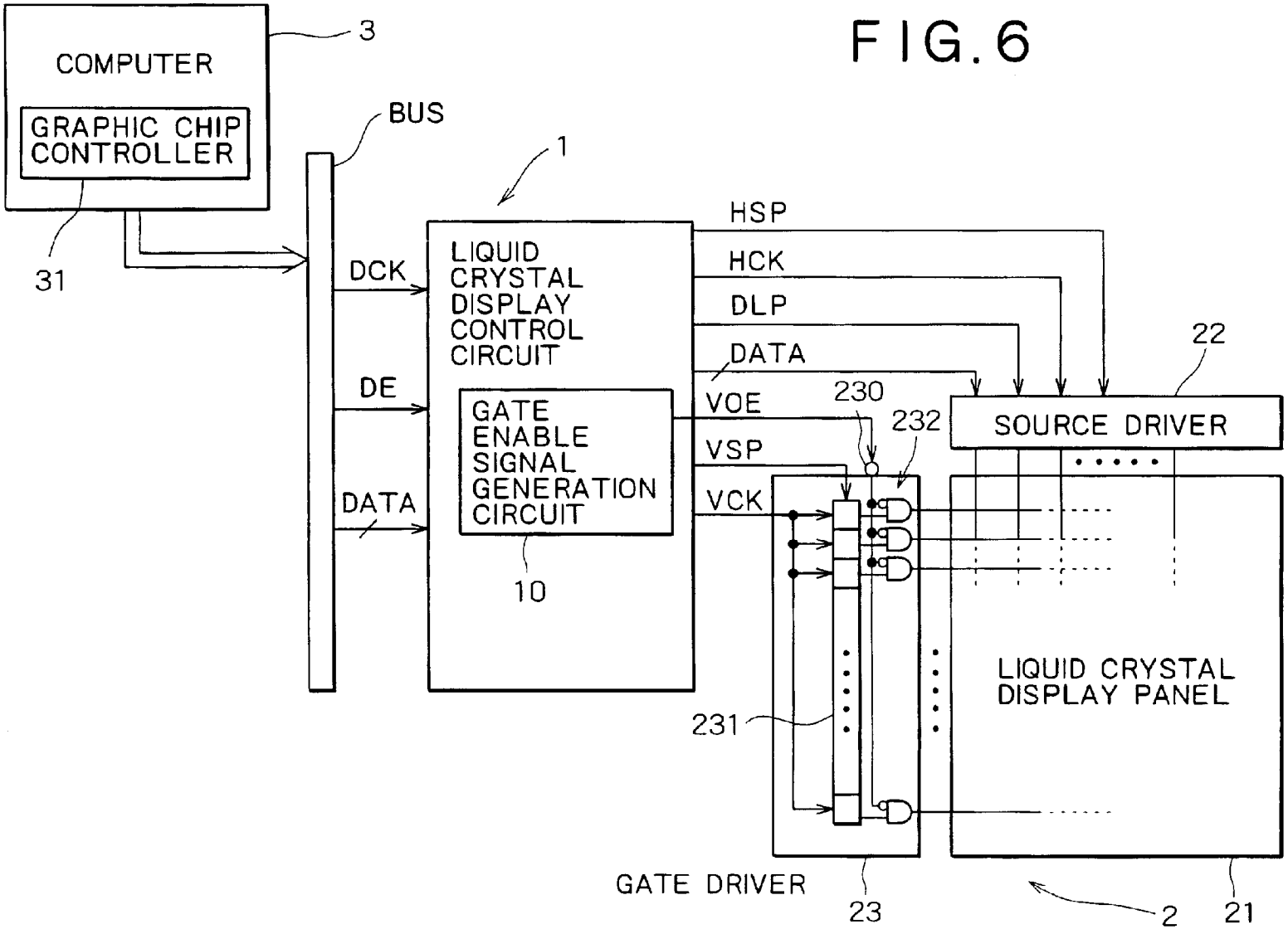
FIG. 6 shows a liquid crystal display control circuit according to an embodiment of the invention.

FIG. 6 is a block diagram showing a liquid crystal display system comprising a liquid crystal display control circuit 1 according to Embodiment 1 of the invention. Similar to the prior art, the liquid crystal display system according to the present embodiment comprises: a computer 3; a liquid crystal display 2; and a liquid crystal display control circuit 1 for receiving the signals from the computer 3 and thereby driving and controlling the liquid crystal display 2.

The liquid crystal display 2 comprises a gate enable terminal 230 for inputting a control signal to a gate driver 23 thereby to control the output thereof. The liquid crystal display control circuit 1 is characterized in comprising a gate enable signal generation circuit 10 for generating a gate driver output enable signal serving as the above-mentioned control signal for controlling the output of the gate driver 23. Described below are the configuration and the function of the sections.

Similar to the prior art, the liquid crystal display 2 comprises: a liquid crystal display panel 21 in which pixel electrodes for displaying and TFT transistors for applying a voltage to each pixel electrode are arranged in a matrix form on a substrate; a source driver 22 arranged on the top side of the liquid crystal display panel 21; and a gate driver 23 arranged on the left side. Display data latched by the source driver 22 on a per-horizontal-line basis is D/A-converted into gradation voltages. The gradation voltages are written into the pixel electrodes of the liquid crystal display panel 21 sequentially on a per-horizontal-line basis. Accordingly, the voltage for each pixel is applied between each pixel electrode and a common electrode. As a result, the transmissivity of the liquid crystal between each electrode pair is controlled in response to the applied voltage, whereby displaying is carried out.

The gate driver 23 of the liquid crystal display 2 comprises: a shift register 231; and an inhibition circuit 232 for controlling and inhibiting a plurality of per-line-based outputs from the shift register 231. The inhibition circuit 232 controls and inhibits the delayed tail of the gate drive signal outputted from the shift register 231 to the gate wires, according to the gate driver output enable signal provided from the gate enable signal generation circuit 10.

Similar to the prior art, in the computer 3, an internal graphic chip controller 31 or the like outputs: display data segmented into each line; a single data enable signal DE in synchronization with the display data DATA; and a dot clock signal DCK in the data rate (repetition frequency) of the display data.

Similar to the prior art, in response to the three signals, the liquid crystal display control circuit 1 outputs various signals to the liquid crystal display 2. That is, on the basis of and in synchronization with a reference signal HRST generated at rise timings of the data enable signal and at a timing delayed by a predetermined time after the last rise within a frame of the data enable signal, the liquid crystal display control circuit 1 outputs: a horizontal start pulse signal HSP; a horizontal clock signal HCK; a data latch pulse signal DLP; a vertical clock signal VCK; and a vertical start pulse signal VSP generated at the beginning of the frame of the data enable signal. The liquid crystal display control circuit further comprises a data conversion section similar to the prior art. In synchronization with the dot clock signal DCK, the data conversion section receives the above-mentioned display data which is 18-bit (6 bits×3) serial data composed of three pieces (for R, G, and B, respectively) of 6-bit data for each pixel. Then, the data conversion section converts the display data into parallel data, and then outputs the data in synchronization with the horizontal clock signal HCK. The signal DCK is an external clock signal in synchronization with the display data, while the signal HCK is an internal clock signal in synchronization with the display data outputted from the liquid crystal display control circuit 1. The signal HCK is generated according to the signal DCK, in a form corresponding to an output display data form determined by the driver group configuration of the source driver (unit) and the input form for the source driver. The vertical clock signal VCK defines the pulse width of the gate drive signal outputted from the gate driver.

Further, in the liquid crystal display control circuit 1, the gate enable signal generation circuit 10 generates a gate driver output enable signal VOE for permitting passage during a predetermined duration of the gate drive signal from the gate driver, and thereby controls the gate driver 23 for the liquid crystal display panel 21. Accordingly, display inhomogeneity caused by a delay in rise timings of the data enable signal DE is avoided.

Figure 7:
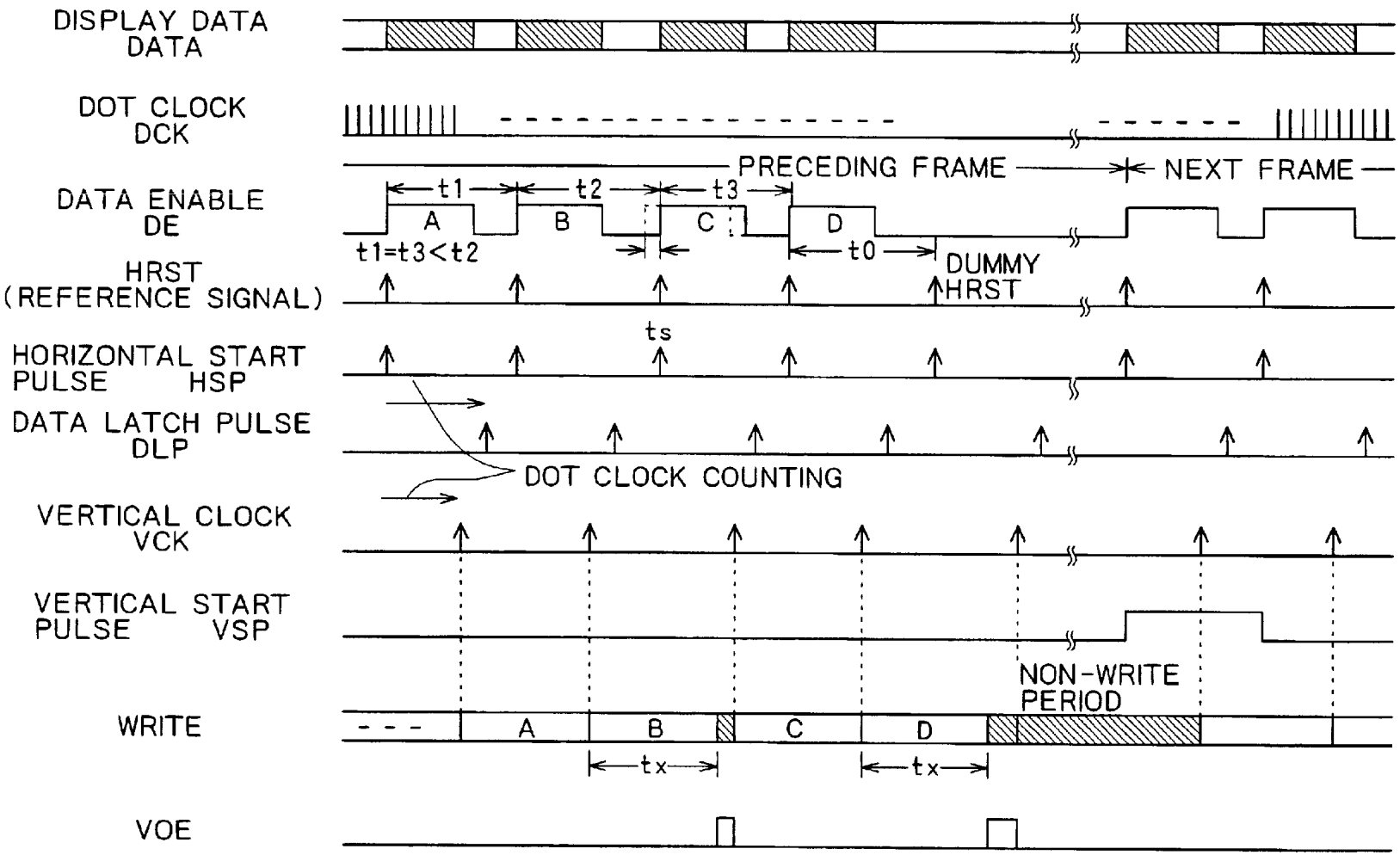
FIG. 7 shows an example of the function and the output signals of a liquid crystal display control circuit according to an embodiment.

FIG. 7 shows an example of the function and the output signals of the liquid crystal display control circuit according to the present embodiment. In the present embodiment, as for the above-mentioned three signals outputted from the computer 3 to the liquid crystal display control circuit 1, the rise timings to the high level of the display data and the data enable signal DE (in which: a data period for each line of the display data is indicated as a valid display data period by a high level; a data intermission is indicated as an invalid period by a low level; and a frame intermission between the last line of a frame and the first line of the next frame is indicated by a low level at a longer time) are delayed as indicated by ts. The distance between the signal HST at this time point ts and the preceding signal HSP is longer than others. The signal HRST generated after the last line of the display data D is generated at a distance (maximum value plus a predetermined margin) greater than the maximum value of the previous distances. Thus, in the present embodiment, the distance between the signal HRST and the preceding signal HSP is longer than others.

In the present embodiment, the gate enable signal generation circuit 10 generates the gate driver output enable signal VOE relatively to the VCK pulses. Relatively to the VCK pulses, when the next VCK pulse is delayed, the gate driver output enable signal VOE rises at a time point tx where the next VCK pulse was originally to be generated, and then lowers at the next VCK pulse.

The gate driver output enable signal VOE is outputted to the gate enable terminal 230 of the gate driver 23. In the gate driver 23, the gate drive signal provided from the shift register 231 to the gate wires is inhibited by the inhibition circuit 232 during high level periods of the gate driver output enable signal VOE. This equalizes the duration of the write of the gradation voltage applied to the source wires.

Figure 8:
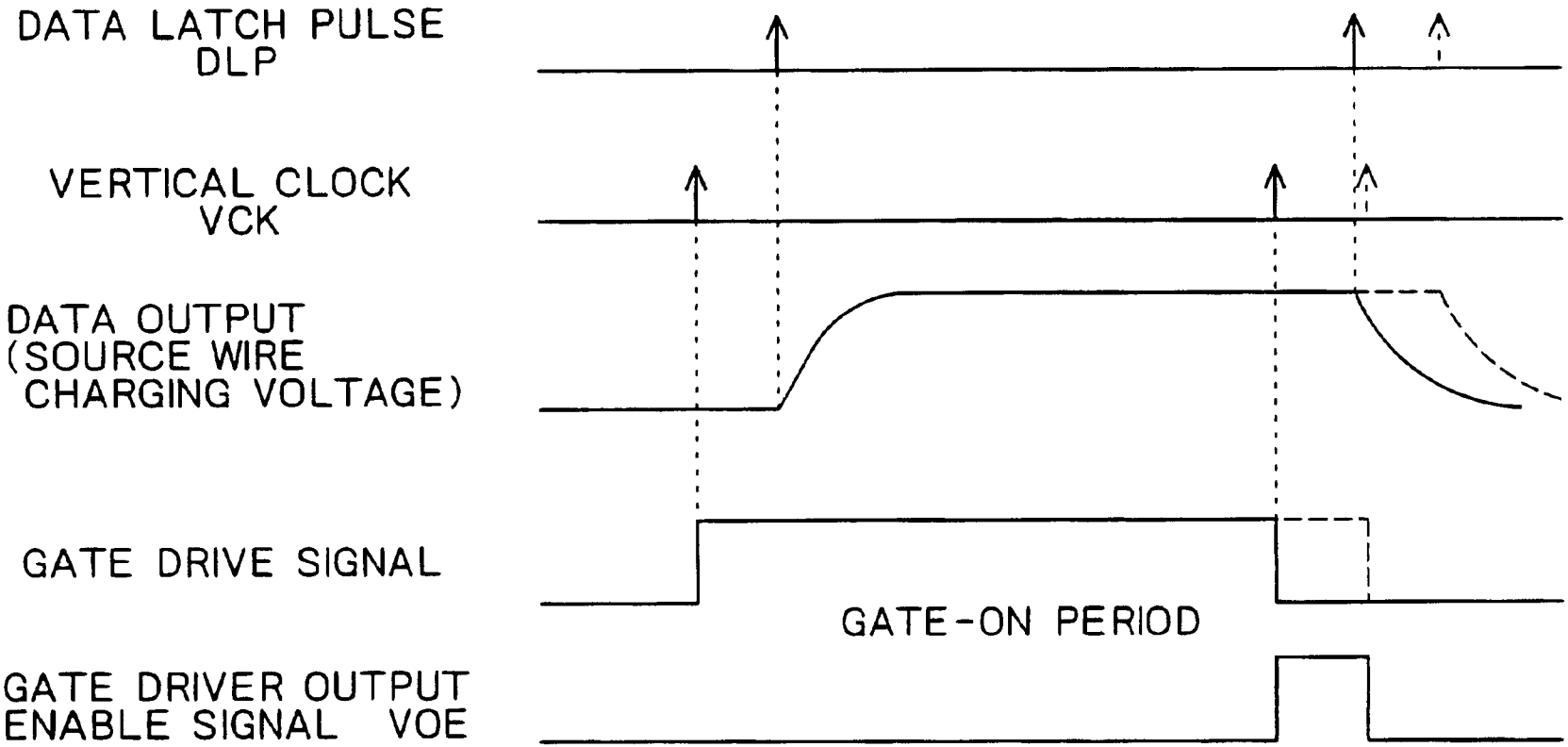
FIG. 8 illustrates the driving operation of a specific gate wire and a specific source wire, and the duration of write (charging) of a gradation voltage, according to an embodiment.

FIG. 8 illustrates driving operation of a specific gate wire and a specific source wire, and the duration of write (charging) of a gradation voltage (gate-ON period), according to an embodiment. This figure illustrates the influence of a delay in the rise timing of the data enable signal. As shown by a broken line, when a delay in the vertical clock signal VCK and the data latch pulse signal DLP is caused by a delay in the rise timing of the data enable signal, the gate drive signal generated according to the vertical clock signal VCK also extends. This extends the duration of charging by the data output (gradation voltage) from the source driver for writing this line, in comparison with the duration of charging for the other lines. Accordingly, the ON period of all the TFT transistors in this line extends. This affects the final charging voltage from the source wires to the pixel electrodes in this line. However, in the present embodiment, the tail of the gate drive signal is not outputted from the gate driver by virtue of the gate driver output enable signal VOE. This equalizes the ON period of the TFT transistors, and suppresses the influence to the final charging voltage. In other words, the write periods for the data B and D are not extended in spite of the delay in the rise timing of the data enable signal DE. Accordingly, all lines are equalized, and the charging voltage for the pixel electrodes to respective gradation voltage levels are also equalized. This avoids display inhomogeneity.

Figure 9:
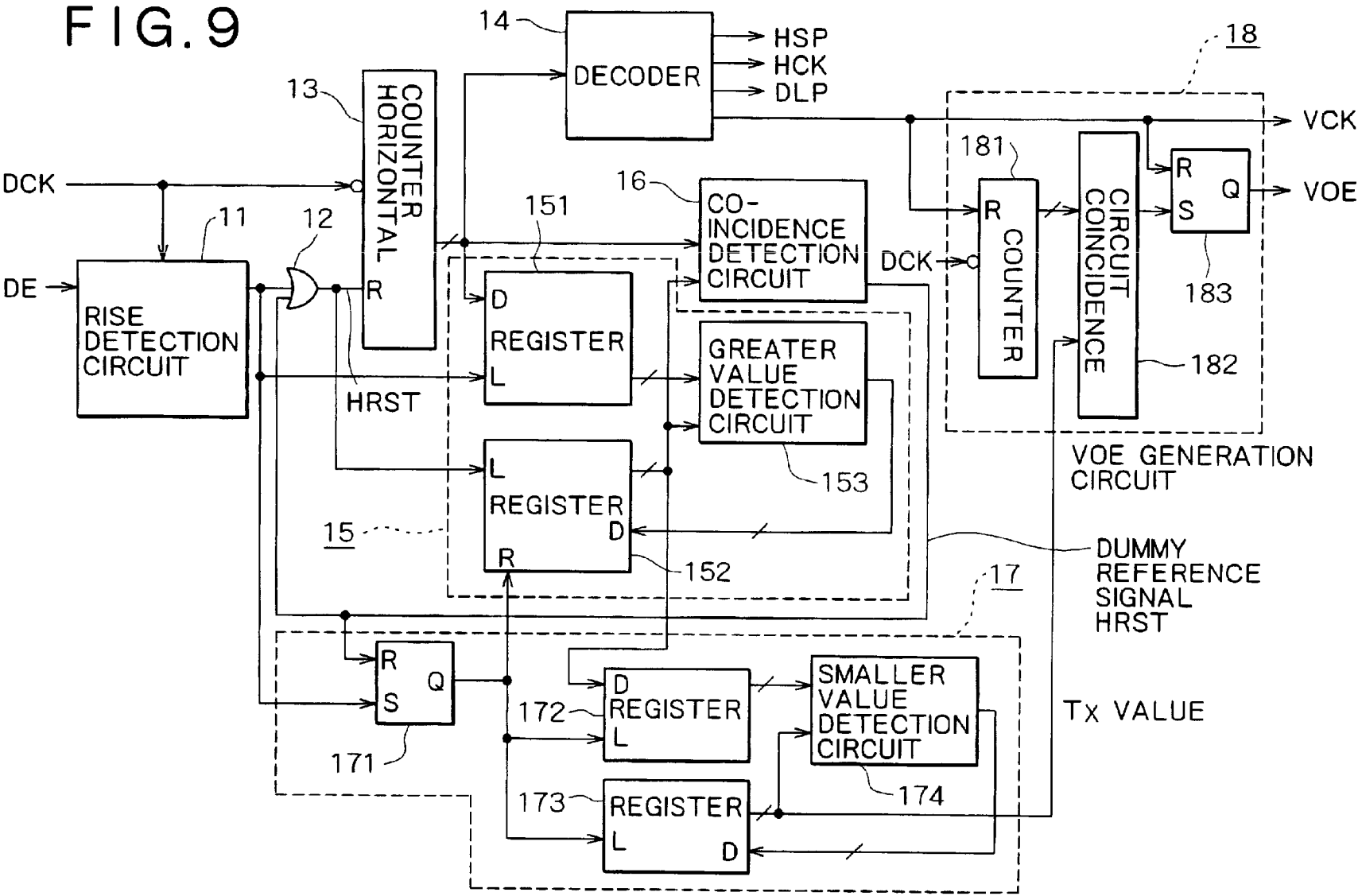
FIG. 9 is a block diagram showing a liquid crystal display control circuit according to an embodiment of the invention.

FIG. 9 is a block diagram showing a detailed configuration of a liquid crystal display control circuit 1 according to an embodiment of the invention. In the present embodiment, the rise timing tx to the high level of the signal VOE is set to be the "intra-frame maximum" and "inter-frame minimum" duration. The liquid crystal display control circuit comprises the above-mentioned data conversion section (not shown).

The circuit comprises: a rise detection circuit 11 for detecting a rise of the data enable signal DE and thereby outputting a pulse at the timing; a horizontal counter 13 which is reset at a rise of the data enable signal DE, then counts the dot clock signal DCK, and thereby outputs the count value data; a decoder 14 for decoding the count value data from the horizontal counter 13, and thereby outputting a horizontal start pulse signal HSP (for horizontal synchronization provided to the source driver in synchronization with the signal DE), a horizontal clock signal HCK, a data latch pulse signal DLP, and a vertical clock signal VCK; a maximum value detection circuit 15 for sequentially comparing the pulse spacing of the signal HSP within a line on the basis of the above-mentioned count value, and thereby determining the maximum spacing (maximum value) t0 among the count values; a tx setting circuit 17 for sequentially comparing the maximum value t0 within a frame, and thereby determining the intra-frame maximum and inter-frame minimum value tx; and a VOE generation circuit 18 for outputting the signal VOE on the basis of the value tx determined by the tx setting circuit 15.

The operation of the liquid crystal display control circuit 1 shown in FIG. 9 is described below in detail with reference to the exemplary output signals shown in FIG. 7.

The rise detection circuit 11 reads the data enable signal DE according to the dot clock signal DCK, and thereby outputs a rise pulse of the signal DE. The horizontal counter 13 counts the dot clock signal DCK, while the count value is reset by a rise pulse of the signal DE. That is, the horizontal counter 13 repeatedly outputs the count value of the signal DCK between a rise pulse spacing of the signal DE. The decoder 14 decodes the count value, then adds the data to the signal HSP delayed by several dot clocks (five dot clocks) from the rise timing of the signal DE, and then outputs the vertical clock signal VCK and the data latch pulse signal DLP for vertical synchronization at timings before the fall and after the rise, respectively, of the signal DE.

The maximum value detection circuit 15 comprises: a register 151; a register 152 for retaining the maximum value; and a greater value detection circuit 153. The register 151 latches and retains the count value of the horizontal counter 13 at the timing of a rise of the signal DE. At this time, the greater value detection circuit 153 compares the value presently retained in the register 152 for retaining the maximum value with the present count value, and thereby outputs the greater value to the register 152. The value is latched and retained at a rise timing of the signal DE via an OR circuit 12. That is, the count value t0 corresponding to the present maximum spacing is retained in the register 152 at each output timing of the OR circuit 12.

A coincidence detection circuit 16 compares the sum t0 (=tmax+$\alpha$) between the count value tmax retained in the register 152 of the maximum value detection circuit 15 and a predetermined margin $\alpha$, with the count value tmax in the horizontal counter 13, and thereby outputs the dummy reference signal HRST at a timing of the coincidence of these values. Thus, the coincidence detection circuit 16 does not output the signal HRST on a per-line basis, but outputs the signal HRST only at a long low level period between frames where the count value in the horizontal counter 13 reaches the value t0.

In the tx setting circuit 17, a RS flip-flop 171 is set at the rise timing of the first signal DE within a frame, then reset by the signal HRST, and thereby outputs a pulse on a per-frame basis. A register 172 latches and retains the count value retained in the maximum-value retaining register 152 of the circuit 15 at the beginning of a frame. A smaller value detection circuit 174 compares this value with the value in a register 173 for retaining the present minimum count value, and thereby latches and retains the smaller value into the register 173. Accordingly, the register 173 outputs the intra-frame maximum and inter-frame minimum value tx.

In the VOE generation circuit 18, a coincidence circuit 182 compares the count value in a counter 181 which is reset by the signal VCK and which counts the dot clock signal DCK, with the value tx. At the time of coincidence, a flip-flop 183 is set, and later reset by the signal VCK, whereby the signal VOE is generated. That is, the flip-flop 183 outputs the pulse signal VOE which rises when the time has elapsed from a VCK pulse by the intra-frame maximum and inter-frame minimum value tx, and which lowers at the next VCK pulse.

By virtue of the above-mentioned operation, the gate enable signal VOE generated by the liquid crystal display control circuit 1 prohibits the inhibition circuit 232 of the gate driver 23, and thereby prohibits the passage of the tail extension of the gate drive signal. As a result, in spite of a variation in the low level of the data enable signal DE, the duration of write (charging) of the data output (gradation voltage) from the source driver 22 into the pixel electrodes is equalized. This avoids display inhomogeneity.

The above-mentioned determination of the intra-frame maximum and inter-frame minimum value tx carried out in the tx setting circuit 17 is described below in further detail with reference to FIG. 10.

FIGS. 10A to 10C show the method of determination of the intra-frame maximum and inter-frame minimum value tx according to the above-mentioned operation. FIG. 10A shows an exemplary time-dependent transition of the intra-frame maximum value and the inter-frame minimum value. FIG. 10B shows the timing of generation of the signal HRST. FIG. 10C shows the period of writing the last line.

As shown in FIG. 10A, intra-frame maximum values in successive frames 1, 2, 3, and 4 are tmax1, tmax2, tmax3, and tmax4, respectively. Assumed is the relation tmax3<tmax1<tmax2<tmax4. Then, the intra-frame maximum value changes in the order tmax1, tmax2, tmax2, and tmax4, while the intra-frame maximum and inter-frame minimum value tx changes in the order tmax1, tmax1, tmax3, and tmax3.

Accordingly, the timing of generation of the dummy reference signal HRST in each frame 1–4 is as shown in FIG. 10B. The period of writing the last line and the period of non-write determined by the signal VOE in each frame 1–4 are as shown in FIG. 10C.

According to the control of the present embodiment, the period of writing the last line eventually approaches the standard horizontal period.

In the above-mentioned embodiment, the value tx can be determined by various methods. These methods of determination of the value tx are described below.

(1) Fixed Value

Depending on the data processing method in the computer providing the display data, when the minimum value of the spacing of the rise timings of the data enable signal is approximately constant, a fixed value which is the sum between this minimum value and a desired margin may be used as the value tx. In this case, the tx setting circuit 17 is replaced by a register circuit or the like for setting and outputting the fixed value tx.

(2) Minimum Value within Horizontal Period

When the minimum value of the spacing of the rise timings of the data enable signal is detected, and when the period of writing each line is set to this common minimum value, the period of write is equalized. In this case, the data input terminal D of the register 172 in the tx setting circuit 17 shown in FIG. 9 may be changed such as to receive the count value data outputted from the horizontal counter 13. Alternatively, the greater value detection circuit 153 in the maximum value detection circuit 15 may be replaced by a smaller value detection circuit (for example, a circuit 174 as shown in FIG. 9). In each case of the fixed value or the minimum value, the signal VOE is composed of pulses which lower at the signal VCK and rise after a predetermined time corresponding to the fixed value or the minimum value.

(3) Mean Value or Most Frequent Value

Display inhomogeneity is suppressed when the period of write is equalized. Thus, the mean value or the most frequent value of the spacing of the rise timings of the data enable signal within each horizontal period may be used. In this case, the tx setting circuit 17 shown in FIG. 9 is replaced by calculating means of receiving the count value data outputted from the horizontal counter 13 on a per-frame basis, and thereby selecting the mean count value or the most frequent count value on the basis of the history of the spacing on a per-line basis. The mean count value is obtained, for example, by accumulating the count values and then dividing the total count value by the sum between the number of the occurrence of the count values and unity. The most frequent value is obtained, for example, by rounding each count value into a predetermined digit and thereby selecting the most frequent value.

According to the invention, the gate drive signal outputted from the gate driver is equalized against a variation in the spacing of the rise timings of the data enable signal and a delay in the dummy reference signal for the last line. This maintains the ON period of the TFT transistors of the liquid crystal display panel to be constant continuously. As a result, the influence to the charging voltage for the pixel electrodes is suppressed against the above-mentioned variation and the like. This avoids display inhomogeneity.

What is claimed is:

1. A liquid crystal display control circuit in which a dot clock signal, per-line based display data, and a data enable signal in synchronization with the display data are received, and thereby the pulse width of a gate drive signal outputted from a gate driver is defined according to a vertical clock signal in synchronization with a reference signal generated at rise timings of the data enable signal and a timing delayed by a predetermined time after the last rise within a frame of the data enable signal, said liquid crystal display control circuit comprising, a gate enable signal generation circuit for outputting a gate driver output enable signal having a predetermined time width starting from the vertical clock signal, whereby the gate driver is controlled and enabled to output the gate drive signal only during the predetermined time width of the gate driver output enable signal, and whereby a variation in the rise timings of the data enable signal affecting displays is suppressed.

2. A liquid crystal display control circuit according to claim 1, wherein said liquid crystal display control circuit outputs: display data, a horizontal start pulse signal, a horizontal clock signal, and a data latch signal for controlling the latching of the per-line-based display data, to a source driver; and a vertical start pulse signal to a gate driver; in synchronization with the reference signal.

3. A liquid crystal display control circuit according to claim 1, wherein the predetermined time width of the gate driver output enable signal is set to be the intra-frame maximum value and the inter-frame minimum value of the spacing of the reference signal generated at rise timings of the data enable signal.

4. A liquid crystal display control circuit according to claim 2, wherein the predetermined time width of the gate driver output enable signal is set to be the intra-frame maximum value and the inter-frame minimum value of the spacing of the reference signal generated at rise timings of the data enable signal.

5. A liquid crystal display control circuit according to claim 3, comprising:

a horizontal counter which is reset by the reference signal generated at rise timings of the data enable signal, and then counts the dot clock signal;

an intra-frame maximum value retaining register for sequentially comparing the maximum count value of the horizontal counter before each reset, and thereby retaining the greater count value;

an inter-frame minimum value retaining register for comparing sequentially frame by frame the count value retained in the intra-frame maximum value retaining register, and thereby retaining the smaller count value; and a decoder for comparing the count value in the horizontal counter with the count value in the intra-frame maximum value retaining register, thereby generating the reference signal at a timing delayed by a predetermined time after the last rise within a frame of the data enable signal, and thereby resetting the horizontal counter, wherein said gate enable signal generation circuit compares the count value in a counter which is reset by the vertical clock signal and then counts the dot clock signal with the count value in the inter-frame minimum value retaining register, and thereby outputting a gate driver output enable signal having a predetermined time width.

6. A liquid crystal display control circuit according to claim 4, comprising:

a horizontal counter which is reset by the reference signal generated at rise timings of the data enable signal, and then counts the dot clock signal;

an intra-frame maximum value retaining register for sequentially comparing the maximum count value of the horizontal counter before each reset, and thereby retaining the greater count value;

an inter-frame minimum value retaining register for comparing sequentially frame by frame the count value retained in the intra-frame maximum value retaining register, and thereby retaining the smaller count value; and a decoder for comparing the count value in the horizontal counter with the count value in the intra-frame maximum value retaining register, thereby generating the reference signal at a timing delayed by a predetermined time after the last rise within a frame of the data enable signal, and thereby resetting the horizontal counter, wherein said gate enable signal generation circuit compares the count value in a counter which is reset by the vertical clock signal and then counts the dot clock signal with the count value in the inter-frame minimum value retaining register, and thereby outputting a gate driver output enable signal having a predetermined time width.

7. A liquid crystal display control circuit according to claim 1, wherein the predetermined time width of the gate driver output enable signal is set to be a fixed value not exceeding the intra-frame maximum value of the spacing of the reference signal generated at rise timings of the data enable signal.

8. A liquid crystal display control circuit according to claim 2, wherein the predetermined time width of the gate driver output enable signal is set to be a fixed value not exceeding the intra-frame maximum value of the spacing of the reference signal generated at rise timings of the data enable signal.

9. A liquid crystal display control circuit according to claim 7, comprising:

a horizontal counter which is reset by the reference signal generated at rise timings of the data enable signal, and then counts the dot clock signal;

an intra-frame maximum value retaining register for sequentially comparing the maximum count value of the horizontal counter before each reset, and thereby retaining the greater count value; and a decoder for comparing the count value in the horizontal counter with the count value in the intra-frame maximum value retaining register, thereby generating the reference signal at a timing delayed by a predetermined time after the last rise within a frame of the data enable signal, and thereby resetting the horizontal counter, wherein said gate enable signal generation circuit compares the count value in a counter which is reset by the vertical clock signal and then counts the dot clock signal with a fixed number corresponding to the fixed value, and thereby outputting a gate driver output enable signal having a predetermined time width.

10. A liquid crystal display control circuit according to claim 8, comprising:

a horizontal counter which is reset by the reference signal generated at rise timings of the data enable signal, and then counts the dot clock signal;

an intra-frame maximum value retaining register for sequentially comparing the maximum count value of the horizontal counter before each reset, and thereby retaining the greater count value; and a decoder for comparing the count value in the horizontal counter with the count value in the intra-frame maximum value retaining register, thereby generating the reference signal at a timing delayed by a predetermined time after the last rise within a frame of the data enable signal, and thereby resetting the horizontal counter, wherein said gate enable signal generation circuit compares the count value in a counter which is reset by the vertical clock signal and then counts the dot clock signal with a fixed number corresponding to the fixed value, and thereby outputting a gate driver output enable signal having a predetermined time width.

11. A liquid crystal display control circuit according to claim 1, wherein the predetermined time width of the gate driver output enable signal is set to be the intra-frame minimum value of the spacing of the reference signal generated at rise timings of the data enable signal.

12. A liquid crystal display control circuit according to claim 2, wherein the predetermined time width of the gate driver output enable signal is set to be the intra-frame minimum value of the spacing of the reference signal generated at rise timings of the data enable signal.

13. A liquid crystal display control circuit according to claim 11, comprising:

a horizontal counter which is reset by the reference signal and then counts the dot clock signal;

an intra-frame maximum value retaining register for sequentially comparing the maximum count value of the horizontal counter before each reset, and thereby retaining the greater count value;

an intra-frame minimum value retaining register for sequentially comparing the maximum count value of the horizontal counter before each reset, and thereby retaining the smaller count value; and a decoder for comparing the count value in the horizontal counter with the count value retained in the intra-frame maximum value retaining register, thereby generating the reference signal at a timing delayed by a predetermined time after the last rise within a frame of the data enable signal, and thereby resetting the horizontal counter, wherein said gate enable signal generation circuit compares the count value in a counter which is reset by the vertical clock signal and then counts the dot clock signal with the count value in the intra-frame minimum value retaining register, and thereby outputting a gate driver output enable signal having a predetermined time width.

14. A liquid crystal display control circuit according to claim 12, comprising:

a horizontal counter which is reset by the reference signal and then counts the dot clock signal;

an intra-frame maximum value retaining register for sequentially comparing the maximum count value of the horizontal counter before each reset, and thereby retaining the greater count value;

an intra-frame minimum value retaining register for sequentially comparing the maximum count value of the horizontal counter before each reset, and thereby retaining the smaller count value; and a decoder for comparing the count value in the horizontal counter with the count value retained in the intra-frame maximum value retaining register, thereby generating the reference signal at a timing delayed by a predetermined time after the last rise within a frame of the data enable signal, and thereby resetting the horizontal counter, wherein said gate enable signal generation circuit compares the count value in a counter which is reset by the vertical clock signal and then counts the dot clock signal with the count value in the intra-frame minimum value retaining register, and thereby outputting a gate driver output enable signal having a predetermined time width.

15. A liquid crystal display control circuit according to claim 1, wherein the predetermined time width of the gate driver output enable signal is set to be the intra-frame mean count value or the most frequent count value of the spacing of the reference signal generated at rise timings of the data enable signal.

16. A liquid crystal display control circuit according to claim 2, wherein the predetermined time width of the gate driver output enable signal is set to be the intra-frame mean count value or the most frequent count value of the spacing of the reference signal generated at rise timings of the data enable signal.

17. A liquid crystal display control circuit according to claim 15, comprising:

a horizontal counter which is reset by the reference signal generated at rise timings of the data enable signal, and then counts the dot clock signal;

an intra-frame maximum value retaining register for sequentially comparing the maximum count value of the horizontal counter before each reset, and thereby retaining the greater count value;

calculating means for outputting the mean count value or the most frequent count value of the maximum count value in the horizontal counter; and a decoder for comparing the count value in the horizontal counter with the count value in the intra-frame maximum value retaining register, thereby generating the reference signal at a timing delayed by a predetermined time after the last rise within a frame of the data enable signal, and thereby resetting the horizontal counter, wherein said gate enable signal generation circuit compares the count value in a counter which is reset by the vertical clock signal and then counts the dot clock signal with the count value outputted from the calculating means, and thereby outputting a gate driver output enable signal having a predetermined time width.

18. A liquid crystal display control circuit according to claim 16, comprising:

a horizontal counter which is reset by the reference signal generated at rise timings of the data enable signal, and then counts the dot clock signal;

an intra-frame maximum value retaining register for sequentially comparing the maximum count value of the horizontal counter before each reset, and thereby retaining the greater count value;

calculating means for outputting the mean count value or the most frequent count value of the maximum count value in the horizontal counter; and a decoder for comparing the count value in the horizontal counter with the count value in the intra-frame maximum value retaining register, thereby generating the reference signal at a timing delayed by a predetermined time after the last rise within a frame of the data enable signal, and thereby resetting the horizontal counter, wherein said gate enable signal generation circuit compares the count value in a counter which is reset by the vertical clock signal and then counts the dot clock signal with the count value outputted from the calculating means, and thereby outputting a gate driver output enable signal having a predetermined time width.

* * * * *